US009226550B1

(12) United States Patent
Lin

(10) Patent No.: US 9,226,550 B1
(45) Date of Patent: Jan. 5, 2016

(54) ZIPPER HEAD ASSEMBLY STRUCTURE

(71) Applicant: CHUNG CHWAN ENTERPRISE CO., LTD., Tao Yuan Hsien (TW)

(72) Inventor: Yu-Pau Lin, Taoyuan County (TW)

(73) Assignee: CHUNG CHWAN ENTERPRISE CO., LTD., Tao Yuan Hsien (TW)

( * ) Notice: Subject to any disclaimer, the term of this patent is extended or adjusted under 35 U.S.C. 154(b) by 0 days.

(21) Appl. No.: 14/587,165

(22) Filed: Dec. 31, 2014

(30) Foreign Application Priority Data

Nov. 12, 2014 (TW) ..... 103139261 A

(51) Int. Cl.
*A44B 19/26* (2006.01)
*A44B 19/30* (2006.01)

(52) U.S. Cl.
CPC ..... *A44B 19/262* (2013.01); *A44B 19/26* (2013.01); *A44B 19/308* (2013.01); *Y10T 24/2571* (2015.01); *Y10T 24/2586* (2015.01)

(58) Field of Classification Search
CPC ..... Y10T 24/2566; Y10T 24/257; Y10T 24/2571; Y10T 24/2577; Y10T 24/2586; A44B 19/262; A44B 19/26; A44B 19/30; A44B 19/308
USPC ..... 24/429
See application file for complete search history.

(56) References Cited

U.S. PATENT DOCUMENTS 4,048,699 A * 9/1977 Kanzaka ..... A44B 19/26 24/415
6,654,988 B1 * 12/2003 Chung ..... A44B 19/308 24/419
7,870,650 B2 * 1/2011 Keyaki ..... A44B 19/26 24/421
2008/0222854 A1 * 9/2008 Keyaki ..... A44B 19/26 24/429
2014/0041163 A1 * 2/2014 Hamada ..... A44B 19/308 24/418

* cited by examiner

*Primary Examiner* — Abigail Morrell
(74) *Attorney, Agent, or Firm* — Li & Cai Intellectual Property (USA) Office

(57) ABSTRACT

The instant disclosure relates to a zipper head. The zipper head includes a main structure, a flexible member, a securing member, a replaceable pull tab, a guiding member, and a shaft. The main structure has a first fixing portion and receives the flexible member. The securing member has a second fixing portion corresponding to the first fixing portion. The securing member contacts with the flexible member. The guiding member is pivotally connected to one end of the main structure and contacts with the securing member. A receiving space is cooperatively defined by the main structure, the securing member, and the guiding member. A fixing end of the replaceable pull tab is disposed in the receiving space. The shaft penetrates the main structure and is pivotally connected to the securing member. The instant disclosure also discusses a method for replacing the replaceable pull tab of the zipper head.

10 Claims, 7 Drawing Sheets

ZIPPER HEAD ASSEMBLY STRUCTURE

BACKGROUND OF THE INVENTION

1. Field of the Invention

The instant disclosure relates to a zipper head assembly structure, and more particularly to a zipper head assembly structure with a replaceable pull tab.

2. Description of Related Art

Conventional zipper heads are structures for zipping and unzipping zipper teeth. Due to its convenient operation, the zipper head is widely used on bags and clothing. The principle of zipper lies in: opening and closing the mutually engaging zipper teeth by the back and forth motion of the zipper head.

Conventional zipper heads generally include a main structure, a securing member, a spring, a cap body and a pull tab. The securing member is pressed into the guiding groove of the main structure by the spring. One end of the spring is under the securing member. The cap body is fixed on the main structure such that the securing member and the spring are positioned inside the cap body.

However, the spring of the above conventional zipper head is fixed onto the main structure by riveting. After the spring is fixed onto the main structure, the securing member and the pull tab are fixed together onto the main body such that the pull tab cannot be replaced. However, in practice, downstream manufactures have different needs for pull tabs and often need to replace the same. In particular, some more unique pull tabs are varied and in small quantities, requiring mechanical assembly by hand. Therefore, each type of pull tab requires a specific machine for assembly, increasing the cost of manufacturing.

Hence, the present inventor believes the above mentioned disadvantages can be overcome, and through devoted research combined with application of theory, finally proposes the instant disclosure which has a reasonable design and effectively improves upon the above mentioned disadvantages.

SUMMARY OF THE INVENTION

One aspect of the instant disclosure relates to a zipper head assembly structure with a replaceable pull tab.

One of the embodiments of the instant disclosure provides a zipper head assembly structure, comprising: a main structure, a flexible member, a securing member, a replaceable pull tab, a guiding member, and a shaft. The main structure has a first fixing portion, wherein the main structure includes a zipper head and a cap body disposed on the zipper head. The flexible member is disposed within the main structure. The securing member has a second fixing portion corresponding to the first fixing portion, disposed in the main structure and abutting the flexible member. The replaceable pull tab has a fixing end. The guiding member is pivotally connected to one end of the main structure, wherein the guiding member and the securing member abut each other, the main structure, the securing member, and the guiding member define a receiving space there-between, and the fixing end is disposed in the receiving space. The shaft passes through the main structure and pivotally connected to the securing member. More precisely, the cap body has two opposite first convex bodies and at least one second convex body disposed on an end thereof, and the zipper head has two opposite first abutting portions respectively downwardly abutted against the two first convex bodies and at least one second abutting portion downwardly abutted against the at least one second convex body.

More precisely, the zipper head has a first groove and a second groove, the first groove and the second groove are interconnected at the surface of the zipper head, the cap body has a blocking piece within, the blocking piece abuts the guiding member and the zipper head, the securing member has a pivot base, and the pivot base pivots about the shaft and abuts the flexible member.

More precisely, the cap body has a first protruding block and two second protruding blocks, the blocking piece has a first bend, a second bend, and an opening corresponding to the securing member, the first bend abuts the zipper head, the second bend abuts the guiding member, an end of the opening is disposed around the first protruding block, the two second protruding blocks abut the turning point between the first bend and the second bend.

More precisely, the flexible member is disposed in the first groove, the pivot base has a hook portion, and the hook portion extends downward into the second groove.

More precisely, the pivot base has a latch portion, and the latch portion extends upward and abuts the guiding member.

More precisely, the zipper head has two clips on one end, the two clips each have a first hole, two sides on one end of the cap body each have a second hole, and the shaft passes through the two first holes and the two second holes.

More precisely, the guiding member has a sliding groove and an abutting face, the latch portion is in contact with the sliding groove, and the blocking piece abuts the abutting face.

More precisely, the pivot base has a stop hook extending outward, the cap body has a first retaining point for abutting the pivot base and a second retaining point for abutting the stop hook, and the first fixing portion, the first retaining point and the second retaining point jointly hold the securing member in place, wherein the first fixing portion is a convex portion, and the second fixing portion is a concave portion.

Another one of the embodiments of the instant disclosure provides a zipper head assembly structure, comprising: a main structure, a guiding member, and a replaceable pull tab. The main structure includes a zipper head and a cap body disposed on the zipper head, wherein the cap body has a first end portion and a second end portion opposite to each other, the first end portion of the cap body is positioned on the zipper head, and the second end portion of the cap body is suspended above the zipper head. The guiding member has a first end portion and a second end portion opposite to each other, wherein the first end portion of the guiding member is movably and pivotally disposed on the second end portion of the cap body, and the second end portion of the guiding member is downwardly abutted against the zipper head or upwardly moved to separate from the zipper head. The replaceable pull tab has an end portion disposed among the zipper head, the cap body, and the guiding member. More precisely, the cap body has two opposite first convex bodies and at least one second convex body disposed on an end thereof, and the zipper head has two opposite first abutting portions respectively downwardly abutted against the two first convex bodies and at least one second abutting portion downwardly abutted against the at least one second convex body.

Yet another one of the embodiments of the instant disclosure provides a zipper head assembly structure, comprising: a main structure, a guiding member, and a replaceable pull tab. The main structure includes a zipper head and a cap body disposed on the zipper head, wherein the cap body has a first end portion and a second end portion opposite to each other, the first end portion of the cap body is positioned on the zipper head, and the second end portion of the cap body is suspended above the zipper head. The guiding member has a first end portion and a second end portion opposite to each other, wherein the first end portion of the guiding member is movably and pivotally disposed on the second end portion of the cap body. The replaceable pull tab has an end portion, wherein the guiding member is moved by the end portion of the replaceable pull tab, so as to separate the second end portion of the guiding member from the zipper head. More precisely, the cap body has two opposite first convex bodies and at least one second convex body disposed on an end thereof, and the zipper head has two opposite first abutting portions respectively downwardly abutted against the two first convex bodies and at least one second abutting portion downwardly abutted against the at least one second convex body.

Therefore, the guiding member design of the instant disclosure provides a gap on the main structure for replaceable pull tabs to move in and out of in a convenient operation, effectively reducing labor and the eliminating the need for a new assembly machine.

To further understand the techniques, means and effects of the instant disclosure applied for achieving the prescribed objectives, the following detailed descriptions and appended drawings are hereby referred to, such that, and through which, the purposes, features and aspects of the instant disclosure can be thoroughly and concretely appreciated. However, the appended drawings are provided solely for reference and illustration, without any intention to limit the instant disclosure.

DETAILED DESCRIPTION OF THE PREFERRED EMBODIMENTS

The embodiments of "a zipper head assembly structure" of the instant disclosure are described. Other advantages and objectives of the instant disclosure can be easily understood by one skilled in the art from the disclosure. The instant disclosure can be applied in different embodiments. Various modifications and variations can be made to various details in the description for different applications without departing from the scope of the instant disclosure. The drawings of the instant disclosure are provided only for simple illustrations, but are not drawn to scale and do not reflect the actual relative dimensions. The following embodiments are provided to describe in detail the concept of the instant disclosure, and are not intended to limit the scope thereof in any way.

Figure 1:
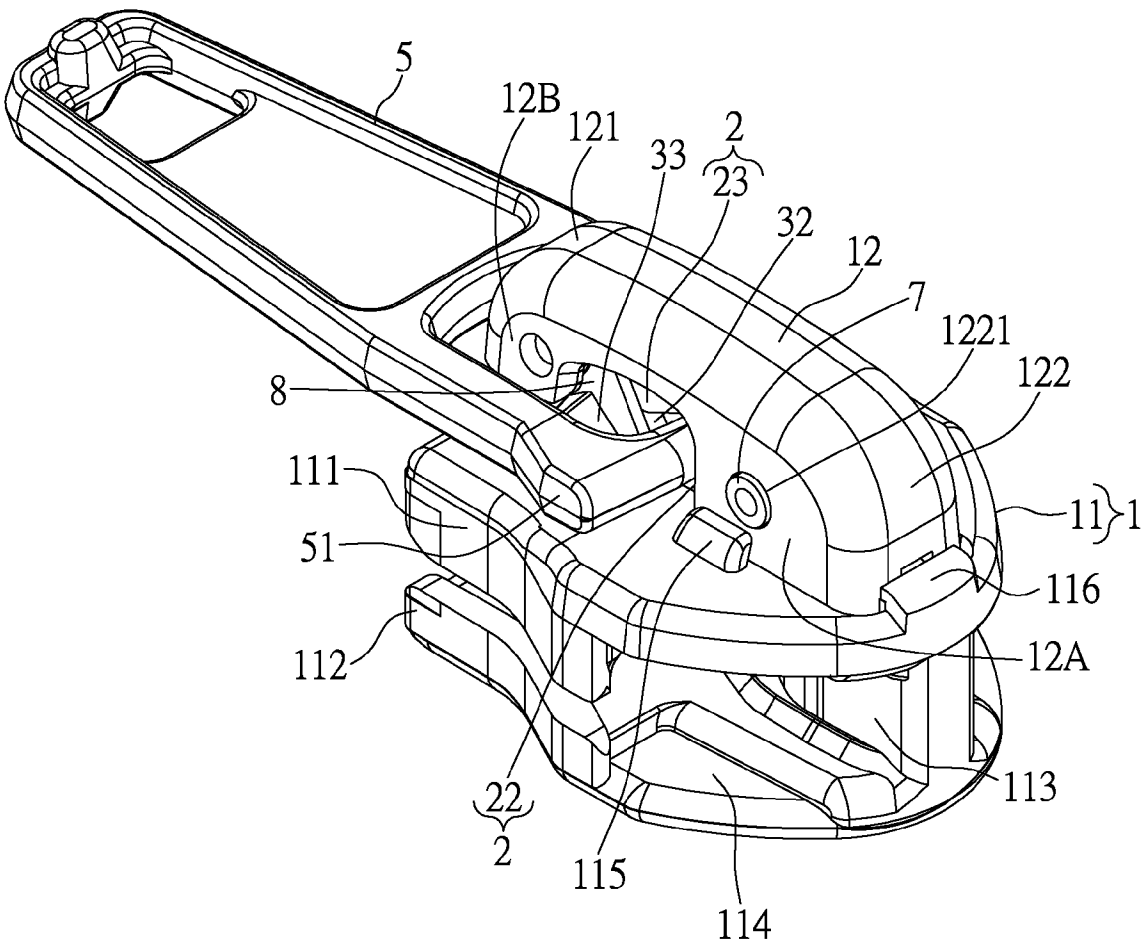
FIG. 1 shows an assembly diagram of a zipper head assembly structure with a replaceable pull tab of the instant disclosure.
Figure 2:
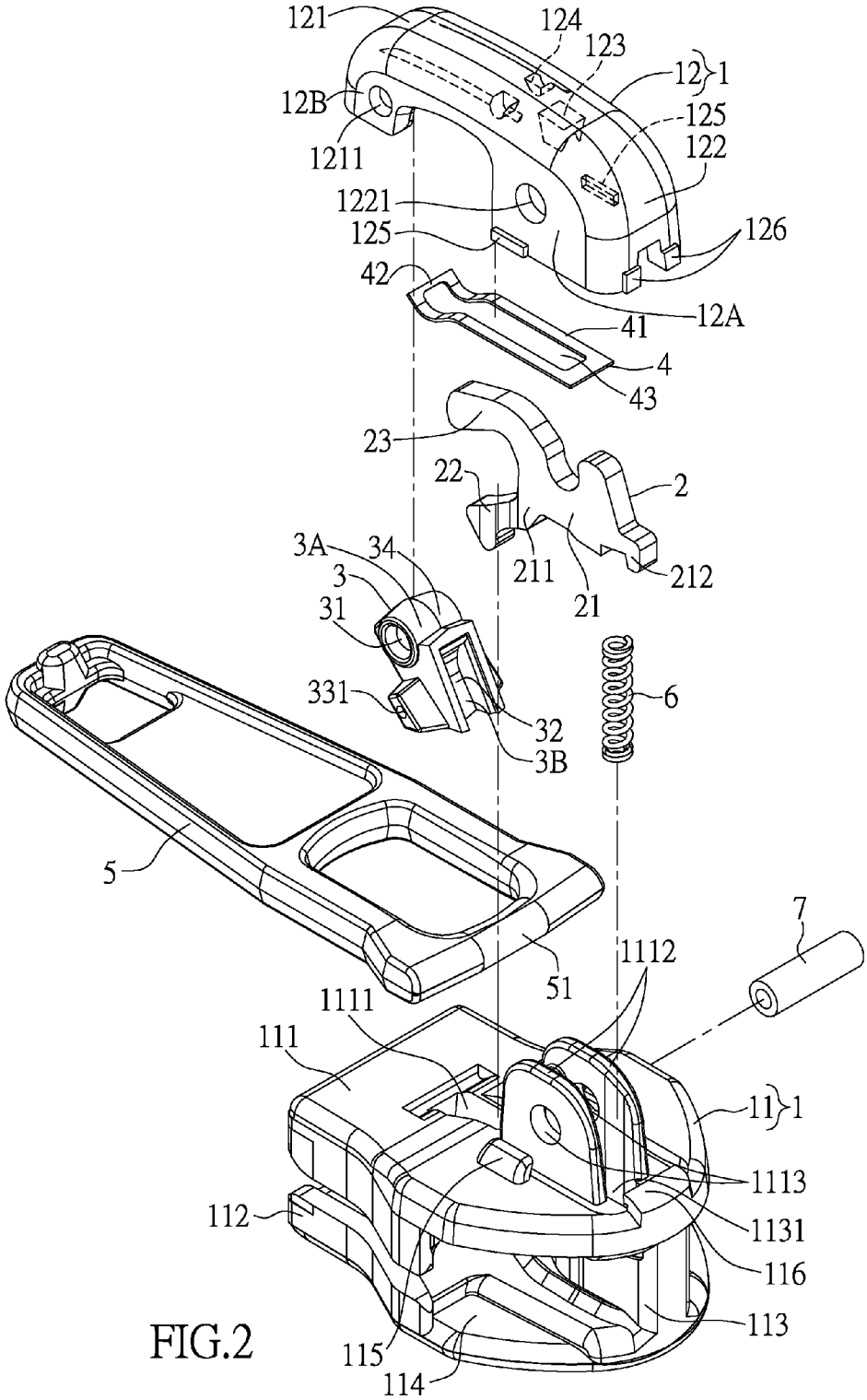
FIG. 2 shows an assembly diagram of a zipper head assembly structure with a replaceable pull tab of the instant disclosure.

Referring to FIG. 1 and FIG. 2, the instant disclosure provides a zipper head assembly structure with a replaceable pull tab, including a main structure 1, a securing member 2, a guiding member 3, a blocking piece 4, a replaceable pull tab 5, a flexible member 6 and a shaft 7. The main structure 1, the securing member 2 and the guiding member 3 jointly define a receiving space 8. The main structure 1 includes a zipper head 11 and a cap body 12. The flexible member 6 is accommodated within the zipper head 11. The securing member 2 is inserted in the zipper head 11 and abuts the flexible member 6. One end of the cap body 12 is pivotally connected to the zipper head 11 and the securing member 2 by the shaft 7. The other end of the cap body 12 is pivotally connected to the guiding member 3. The blocking piece 4 is disposed within the cap body 12 and abuts the zipper head 11 and the guiding member 3. The blocking piece 4 is latched within the receiving space 8.

Figure 3:
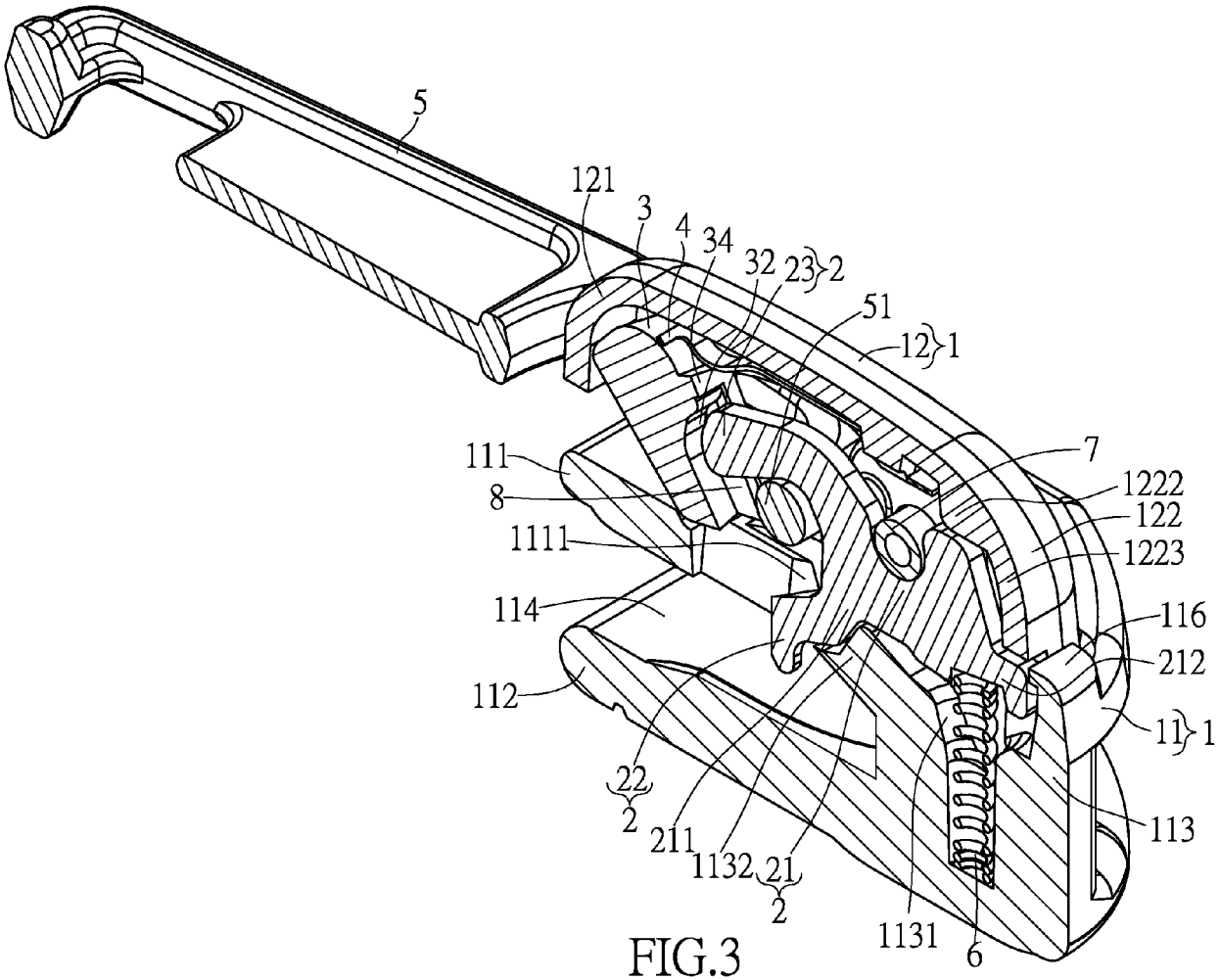
FIG. 3 shows a cross-sectional diagram of a zipper head assembly structure with a replaceable pull tab of the instant disclosure (1)
Figure 4:
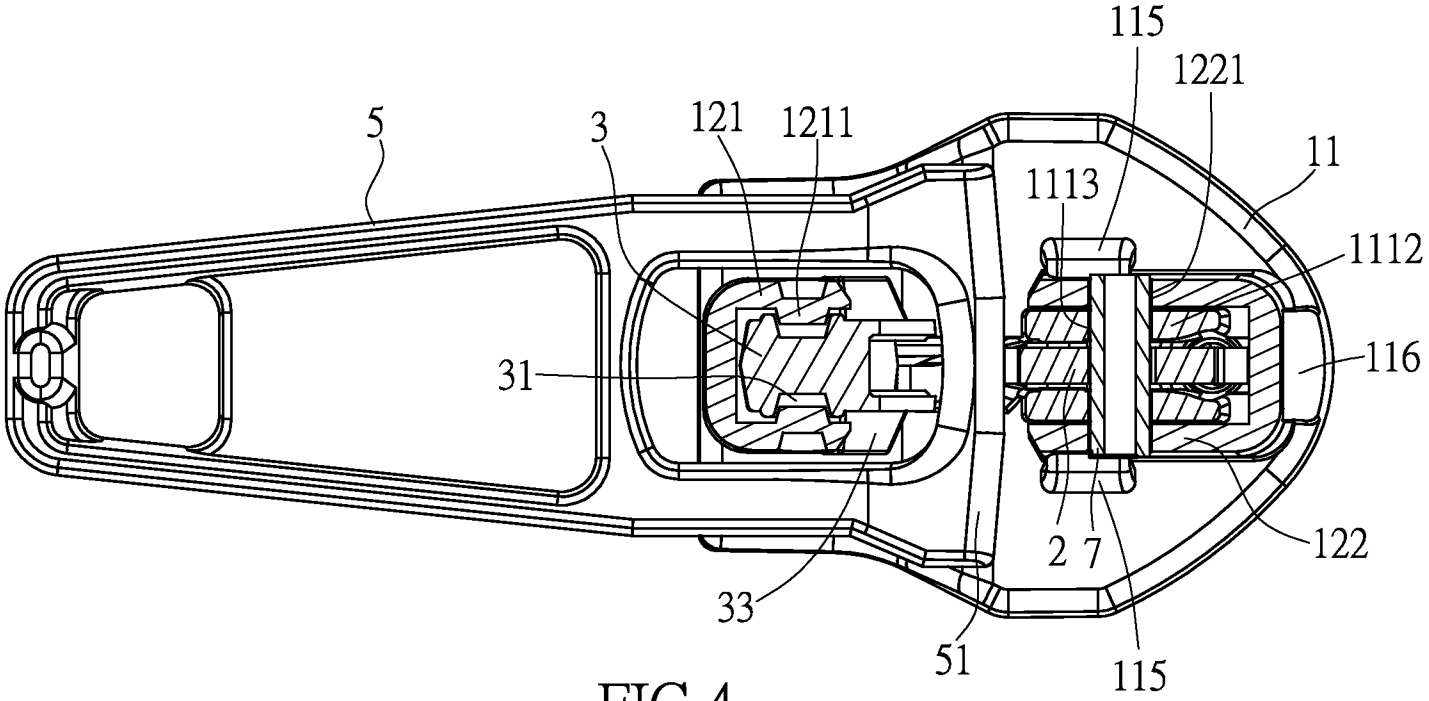
FIG. 4 shows a cross-sectional diagram of a zipper head assembly structure with a replaceable pull tab of the instant disclosure (2)

Referring to FIG. 2 and FIG. 3, the zipper head 11 has an upper board 111, a lower board 112, and a connection portion 113 connecting the upper board 111 and the lower board 112. The upper board 111, the lower board 112 and the connection portion 113 are integrally formed as one body. The connection portion 113 has a first groove 1131 within and a first fixing portion 1132. The upper board 111 has a second groove 1111. The first groove 1131 and the second groove 1111 are interconnected at the surface of the upper board 111. The first groove 1131 houses the flexible member 6. Two clips 1112 are disposed at the interconnection between the first groove 1131 and the second groove 1111. Each of the two clips 1112 has a first hole 1113. The first fixing portion 1132 is actually a protrusion between the two clips 1112. The upper board 111 and the lower board 112 form a guiding groove 114 therebetween. The guiding groove 114 can engage with a teeth chain (not shown in the figures).

Referring to FIG. 2 to FIG. 5A, the shape of the cap body 12 is similar to a telephone receiver, having a front end 121 and a rear end 122, and a hollow interior connected to the outside of the cap body 12. Two sides of the front end 121 each form a protrusion portion 1211 facing inward. Two sides of the rear end 122 each have a second hole 1221. Two edges of the rear end 122 have a first retaining point 1222 and a second retaining point 1223. The inner side of the cap body 12 has a first protruding block 123 and two second protruding blocks 124. The rear end 122 of the cap body 12 is arranged around the two clips 1112. The first holes 1113 of the clips 1112 correspond to the second holes 1221 of the cap body 12. When the cap body 12 and the zipper head 11 are integrated, the rear end 122 of the cap body 12 abuts and is limited by the extension around the first groove 1131 on the upper board 111.

The securing member 2 is roughly branch shaped having three branches. The three branches are respectively a pivot base 21, a hook portion 22 and a latch portion 23. The lower side of the pivot base 21 has a concave second fixing portion 211 corresponding to the first fixing portion 1132. A stop hook 212 extends away from the pivot base 21. The securing member 2 is inserted into the upper board 111 of the zipper head 11. The hook portion 22 extends into the second groove 1111. The pivot base 21 presses against the flexible member 6. The pivot base 21, the first holes 1113 of the clips 1112 and the second holes 1221 of the cap body 12 correspond to each other such that a shaft 7 can pass through to pivotally connect to the first holes 1113, the second holes 1221 and the pivot base 21. It is worth noting that, since the cap body 12 is pressed against the upper board 111, only the securing member 2 can rotate about the shaft 7. When the securing member 2 is in static equilibrium, the stop hook 212 abuts the second retaining point 1223, the convex edge on the upper part of the pivot base 21 abuts the first retaining point 1222, the bottom part of the pivot base abuts the flexible member 6, and the second fixing portion 211 abuts the first fixing portion 1132. However, when the securing member 2 is driven by an external force (e.g., the user pulls on the zipper), the securing member 2 can flip upward and press against the flexible member 6. When the external force abates, the flexible member 6 restores the securing member 2 to its original position.

The guiding member 3 is a specially designed piece that allows the instant disclosure to replace replaceable pull tabs 5. Two sides on one end of the guiding member 3 each have a recessed portion 31 for pivoting with the protrusion portion 1211 of the cap body 12. The shape of the guiding member 3 gradually tapers inward from the periphery of the recessed portion 31. The guiding member 3 has a slanted face and a level face. The slanted face has a sliding groove 32. The other end of the guiding member 3 opposite to the recessed portions 31 has a fin 33 on each of the two sides. The two fins 33 each have a holding hole 331 for adjusting the guiding member 3 when replacing the replaceable pull tab 5. The two recessed portions 31 are pivotally connected to the protrusion portions 1211 such that the operator can rotate the guiding member 3 by applying force on the holding hole 331 (can insert a pin shaped object into the holding hole 331) when replacing the replaceable pull tab 5. The sliding groove 32 and the latch portion 23 of the securing member 2 match each other such that the latch portion 23 can move along the sliding groove 32 as the securing member 2 rotates. In normal use of the zipper, regardless of which direction the user pulls on the replaceable pull tab 5, the guiding member 3 closes upon the gap between the zipper head 11 and the cap body 12 to ensure that the replaceable pull tab 5 does not become detached.

Figure 5A:
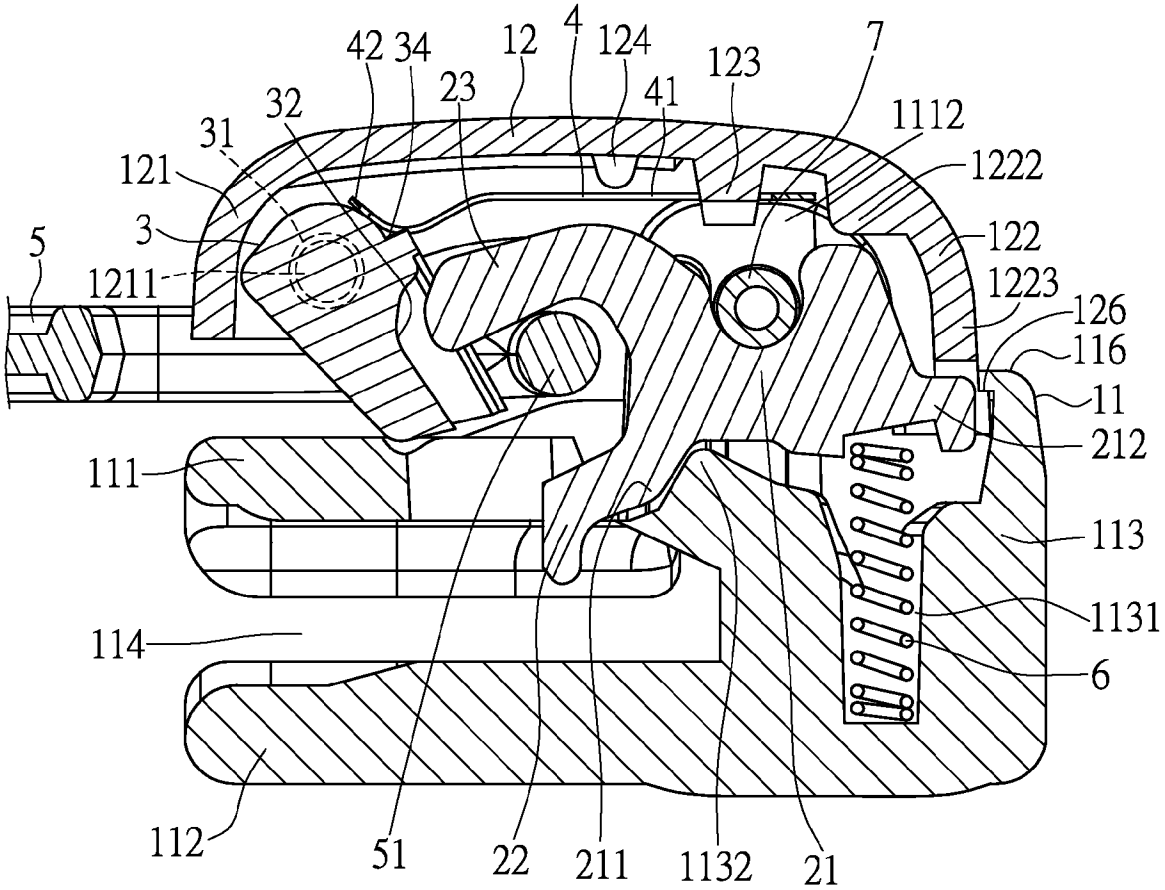
FIG. 5A shows a operation diagram of a zipper head assembly structure with a replaceable pull tab of the instant disclosure (1)

Referring to FIG. 2 and FIG. 5A, the blocking piece 4 is disposed within the hollow portion of the cap body 12, and has a first bend 41, a second bend 42 and an opening 43. The first bend 41 abuts the top part of the clip 1112. The second bend 42 abuts an abutting face 34 of the guiding member 3. One end of the opening 43 is disposed around the first protruding block 123 of the cap body 12. The two second protruding blocks 124 abut against the first bend 41 and the second bend 42. The first bend 41 and the second bend 42 bends at an angle toward the direction of the zipper head 11. This angle allows the blocking piece 4 to resist unintentional movement of the guiding member 3 (e.g. pushing by water flow during washing). The size of the opening 43 can coincide with the latch portion 23 of the securing member 2. Therefore, when the pivot base 21 of the securing member 2 rotates about the shaft 7, the latch portion 23 can pass through the blocking piece 4 without being blocked.

Figure 5B:
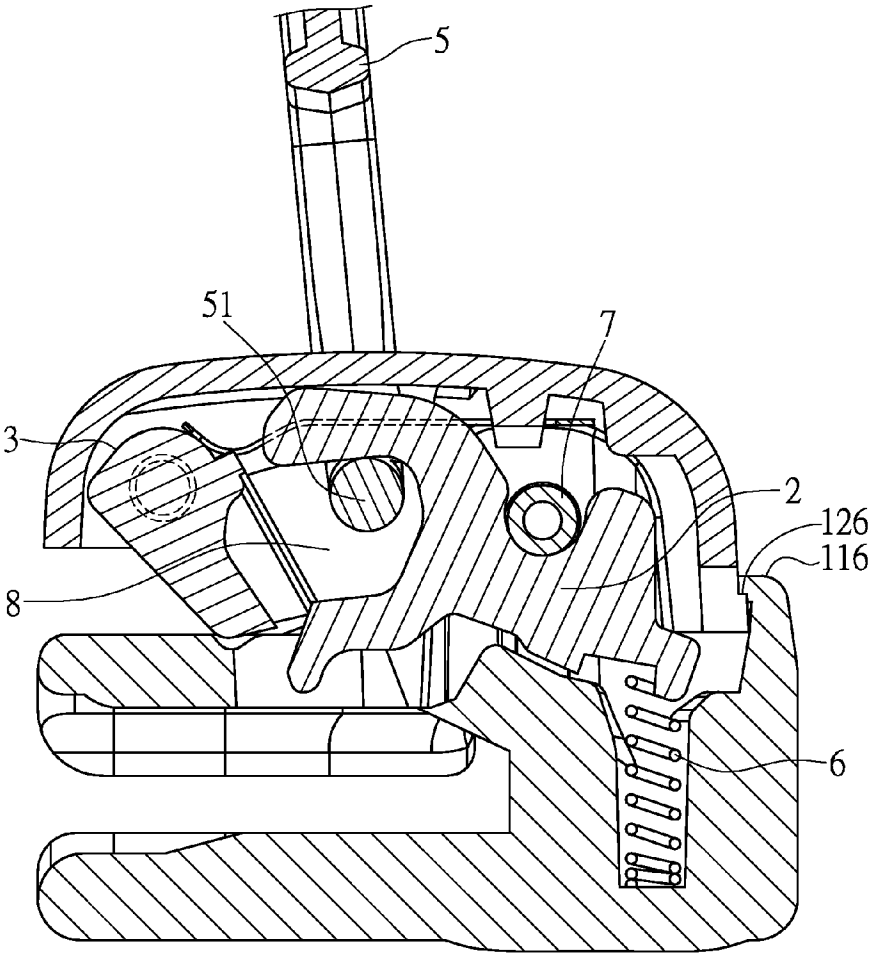
FIG. 5B shows a operation diagram of a zipper head assembly structure with a replaceable pull tab of the instant disclosure (2)
Figure 5C:
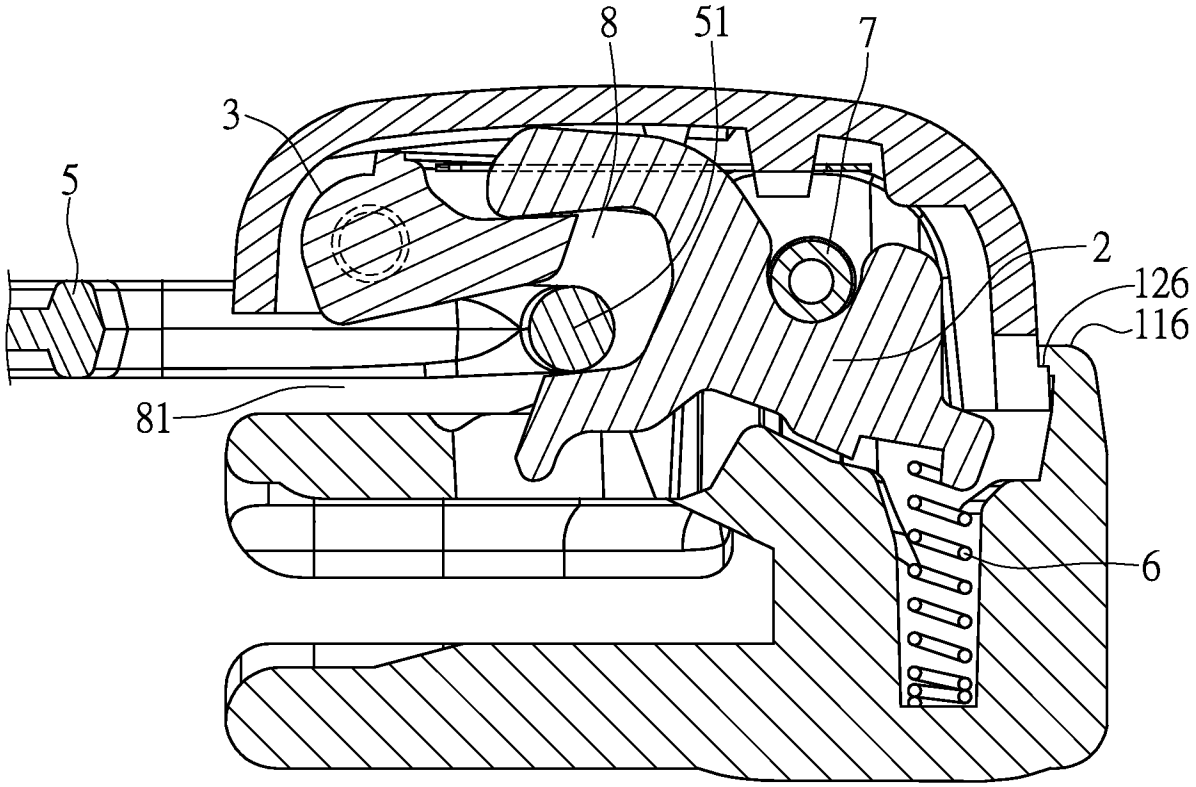
FIG. 5C shows an operation diagram of a zipper head assembly structure with a replaceable pull tab of the instant disclosure (3).

Referring to FIG. 5A to FIG. 5C, the zipper head 11, the securing member 2 and the guiding member 3 define a receiving space 8. The replaceable pull tab 5 can have different patterns printed on its surface (not shown in the figures) and has a fixing end 51. The fixing end 51 is disposed within the receiving space 8. When the securing member 2 or the guiding member 3 is subject to force and rotates, the receiving space 8 accommodating the fixing end 51 changes shape accordingly. When a gap 81 emerges at the receiving space 8, the operator can withdraw or insert replaceable pull tabs 5.

The instant disclosure provides a replaceable pull tab replacement method for a zipper head assembly structure with a replaceable pull tab, including the following steps: referring to FIG. 5A, provide the mentioned zipper head assembly structure with a replaceable pull tab; referring to FIG. 5B, when the replaceable pull tab 5 is to be pulled out, apply an external force on the replaceable pull tab 5 such that the fixing end 51 drives the securing member 2 to rotate about the shaft 7 and increase the receiving space 8 and press against the flexible member 6; referring to FIG. 5C, then apply another external force on the guiding member 3 such that the guiding member 3 yields a gap 81 to the receiving space 8, and the replaceable pull tab 5 is pulled out; stop applying force, and the flexible member 6 provides a restoring force to drive the securing member 2 to rotate about the shaft 7 back to the original position, and the securing member 2 in turn drives the guiding member 3 to move back to the original position; and when another replaceable pull tab 5 is to be inserted, apply an external force at the fixing end 51 of this replaceable pull tab 5 such that the fixing end 51 pushes the guiding member 3 inward to yield the gap 81, and the guiding member 3 raises the securing member 2 and makes the securing member 2 press against the flexible member 6; when the fixing end 51 is pushed to an end, stop applying force, the flexible member 6 then provides a restoring force on the securing member 2 such that the securing member 2 drives the guiding member 3 back to the original position. In other words, when the guiding member 3 is rotated toward the receiving space 8 to form a gap 81 between the guiding member 3 and the zipper head 11, the fixing end 51 can be received in the receiving space 8 or separated from the receiving space 8 through the gap 81.

It is worth mentioning that the instant disclosure provides a zipper head assembly structure, comprising: a main structure 1, a guiding member 3, and a replaceable pull tab 5. The main structure 1 includes a zipper head 11 and a cap body 12 disposed on the zipper head 11. The cap body 12 has a first end portion 12A and a second end portion 12B opposite to each other, the first end portion 12A of the cap body 12 is positioned on the zipper head 11, and the second end portion 12B of the cap body 12 is suspended above the zipper head 11. The guiding member 3 has a first end portion 3A and a second end portion 3B opposite to each other. The first end portion 3A of the guiding member 3 is movably and pivotally disposed on the second end portion 12B of the cap body 12, and the second end portion 3B of the guiding member 3 is selectively downwardly abutted against the zipper head 11 or upwardly moved to separate from the zipper head 11. The replaceable pull tab 5 has an end portion (such as the fixing end 51) disposed among the zipper head 11, the cap body 12, and the guiding member 3. More precisely, the cap body 12 has two opposite first convex bodies 125 and at least one second convex body 126 disposed on an end of the cap body 12, and the zipper head 11 has two opposite first abutting portions 115 respectively downwardly abutted against the two first convex bodies 125 and at least one second abutting portion 116 downwardly abutted against the at least one second convex body 126, so as to firmly fix the first end portion 12A of the cap body 12 on the zipper head 11.

For example, when the guiding member 3 is pushed by the fixing end 51 of the replaceable pull tab 5, the second end portion 12B of the guiding member 12 is upwardly moved and separated from the zipper head 11, so as to place the fixing end 51 of the replaceable pull tab 5 in the receiving space 8 among the zipper head 11, the cap body 12, and the guiding member 3.

In general, the special feature of the instant disclosure lies in the design of the guiding member, which allows the operator to open a gap on the zipper head with simple tools, for removal and insertion of replaceable pull tabs. The procedure is convenient, and the assembly does not require a new machine, thereby reducing the manufacturing cost and raising efficiency. Additionally, the blocking piece prevents the guiding member from yielding the gap during washing and letting the replaceable pull tab fall out.

The aforementioned descriptions merely represent the preferred embodiments of the instant disclosure, without any intention to limit the scope of the instant disclosure which is fully described only within the following claims. Various equivalent changes, alterations or modifications based on the claims of the instant disclosure are all, consequently, viewed as being embraced by the scope of the instant disclosure.

What is claimed is:

1. A zipper head assembly structure, comprising:

a main structure, having a first fixing portion, wherein the main structure includes a zipper head and a cap body disposed on the zipper head;

a flexible member, disposed within the main structure;

a securing member, having a second fixing portion corresponding to the first fixing portion, disposed in the main structure and abutting the flexible member;

a replaceable pull tab, having a fixing end;

a guiding member, pivotally connected to one end of the main structure, wherein the guiding member and the securing member abut each other, the main structure, the securing member, and the guiding member define a receiving space there-between, and the fixing end is disposed in the receiving space; and a shaft, passing through the main structure and pivotally connected to the securing member;

wherein the cap body has two opposite first convex bodies and at least one second convex body disposed on an end thereof, and the zipper head has two opposite first abutting portions respectively downwardly abutted against the two first convex bodies and at least one second abutting portion downwardly abutted against the at least one second convex body.

2. The zipper head assembly structure according to claim 1, wherein the zipper head has a first groove and a second groove, the first groove and the second groove are interconnected at the surface of the zipper head, the cap body has a blocking piece within, the blocking piece abuts the guiding member and the zipper head, the securing member has a pivot base, and the pivot base pivots about the shaft and abuts the flexible member.

3. The zipper head assembly structure according to claim 2, wherein the cap body has a first protruding block and two second protruding blocks, the blocking piece has a first bend, a second bend, and an opening corresponding to the securing member, the first bend abuts the zipper head, the second bend abuts the guiding member, an end of the opening is disposed around the first protruding block, the two second protruding blocks abut the turning point between the first bend and the second bend.

4. The zipper head assembly structure according to claim 2, wherein the flexible member is disposed in the first groove, the pivot base has a hook portion, and the hook portion extends downward into the second groove.

5. The zipper head assembly structure according to claim 4, wherein the pivot base has a latch portion, and the latch portion extends upward and abuts the guiding member.

6. The zipper head assembly structure according to claim 5, wherein the zipper head has two clips on one end, the two clips each have a first hole, two sides on one end of the cap body each have a second hole, and the shaft passes through the two first holes and the two second holes.

7. The zipper head assembly structure according to claim 5, wherein the guiding member has a sliding groove and an abutting face, the latch portion is in contact with the sliding groove, and the blocking piece abuts the abutting face.

8. The zipper head assembly structure according to claim 2, wherein the pivot base has a stop hook extending outward, the cap body has a first retaining point for abutting the pivot base and a second retaining point for abutting the stop hook, and the first fixing portion, the first retaining point and the second retaining point jointly hold the securing member in place, wherein the first fixing portion is a convex portion, and the second fixing portion is a concave portion.

9. A zipper head assembly structure, comprising:

a main structure including a zipper head and a cap body disposed on the zipper head, wherein the cap body has a first end portion and a second end portion opposite to each other, the first end portion of the cap body is positioned on the zipper head, and the second end portion of the cap body is suspended above the zipper head;

a guiding member having a first end portion and a second end portion opposite to each other, wherein the first end portion of the guiding member is movably and pivotally disposed on the second end portion of the cap body, and the second end portion of the guiding member is downwardly abutted against the zipper head or upwardly moved to separate from the zipper head; and a replaceable pull tab having an end portion disposed among the zipper head, the cap body, and the guiding member;

wherein the cap body has two opposite first convex bodies and at least one second convex body disposed on an end thereof, and the zipper head has two opposite first abutting portions respectively downwardly abutted against the two first convex bodies and at least one second abutting portion downwardly abutted against the at least one second convex body.

10. A zipper head assembly structure, comprising:

a main structure including a zipper head and a cap body disposed on the zipper head, wherein the cap body has a first end portion and a second end portion opposite to each other, the first end portion of the cap body is positioned on the zipper head, and the second end portion of the cap body is suspended above the zipper head;

a guiding member having a first end portion and a second end portion opposite to each other, wherein the first end portion of the guiding member is movably and pivotally disposed on the second end portion of the cap body; and a replaceable pull tab having an end portion, wherein the guiding member is pushed by the end portion of the replaceable pull tab, so as to separate the second end portion of the guiding member from the zipper head;

wherein the cap body has two opposite first convex bodies and at least one second convex body disposed on an end thereof, and the zipper head has two opposite first abutting portions respectively downwardly abutted against the two first convex bodies and at least one second abutting portion downwardly abutted against the at least one second convex body.

* * * * *